US006971136B2

(12) United States Patent
Horvath et al.

(10) Patent No.: US 6,971,136 B2
(45) Date of Patent: Dec. 6, 2005

(54) CLEANER WITH HIGH PRESSURE CLEANING JETS

(75) Inventors: Tibor Horvath, Springfield, NJ (US); Giora Erlich, North Caldwell, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 10/272,754

(22) Filed: Oct. 17, 2002

(65) Prior Publication Data

US 2004/0074524 A1 Apr. 22, 2004

Related U.S. Application Data

(62) Division of application No. 10/109,689, filed on Mar. 29, 2002, now Pat. No. 6,742,613, which is a division of application No. 09/237,301, filed on Jan. 25, 1999, now Pat. No. 6,412,133.

(51) Int. Cl.[7] ..... E04H 4/16
(52) U.S. Cl. ..... 15/1.7; 210/169
(58) Field of Search ..... 15/1.7; 210/169, 210/416.2

(56) References Cited

U.S. PATENT DOCUMENTS 3,102,289 A 9/1963 Norris
3,287,755 A 11/1966 Pansini
3,412,862 A 11/1968 Chaplin ..... 210/73
3,444,575 A 5/1969 Martin
4,193,228 A 3/1980 Bowler ..... 51/170 T
4,429,429 A 2/1984 Altschul ..... 15/50 R
5,099,535 A 3/1992 Chauvier et al.
5,133,503 A 7/1992 Giordano et al. ..... 239/532
5,197,158 A 3/1993 Moini ..... 15/1.7
5,336,403 A 8/1994 Marbach ..... 210/169
5,893,188 A * 4/1999 Campbell et al. ..... 15/1.7
6,017,400 A * 1/2000 Clark et al. ..... 134/21
6,365,039 B1 * 4/2002 Henkin et al. ..... 210/103
6,412,133 B1 * 7/2002 Erlich et al. ..... 15/1.7

* cited by examiner

*Primary Examiner*—John Kim
*Assistant Examiner*—Shay Balsis
(74) *Attorney, Agent, or Firm*—Abelman, Frayne & Schwab

(57) ABSTRACT

A swimming pool cleaner discharges water jets under the cleaner body, directed toward its center from its sides, to agitate and lift debris toward one or more vacuum intake openings, to greatly enhance the cleaning ability of the cleaner. The suspended dirt and debris become semi-buoyant under the force of the jetted water which is preferably moving in the same direction as the cleaner, so that the relative speed between the cleaner and the suspended dirt and debris is reduced, thereby enabling the cleaner to move at a relatively faster rate and still clean with equivalent or even greater efficiency than a pool cleaner that is not equipped with directional cleaning water jets. In addition, displaced front and back orientations of the intake ports allow for longer time for any dirt and debris to be picked up.

16 Claims, 12 Drawing Sheets

CLEANER WITH HIGH PRESSURE CLEANING JETS

"This is a divisional application of U.S. Ser. No. 10/109,689, filed Mar. 29, 2002, now U.S. Pat. No. 6,742,613, which is a division of U.S. Ser. No. 09/237,301 filed Jan. 25, 1999, now U.S. Pat. No. 6,412,133, the disclosure of which is incorporated herein its entirety by reference."

FIELD OF THE INVENTION

This invention relates to hand-powered and self-propelled pool and tank cleaners that draw water containing dirt and debris from the surface beneath the moving pool cleaner for entrainment in a filter.

BACKGROUND OF THE INVENTION

One of the most common problems that occurs in the disrupting of the efficient operation and pre-determined movement patterns of an automated swimming pool cleaner are discontinuities in and obstacles protruding from the bottom surface of the pool. When a self-propelled cleaner encounters and attempts to pass over or around an obstacle, it can become immobilized, particularly if the obstacle engages the opening of the vacuum intake. One approach to solving this problem has been to design the cleaner so that its baseplate and associated water intake is raised as high as possible from the surface to be vacuumed. However, the higher the intake, the less effective the vacuuming becomes. Debris is also left behind when the cleaner is moving rapidly. To counter these problems, the pool cleaner is programmed to move about its route at a rather sluggish pace. The result is that it may take many hours to clean an average size swimming pool.

It has also been proposed to equip the pool cleaner with flexible intake adapters to enhance the surface vacuuming ability of the cleaner. The intake adapters are also subject to being immobilized on steps or other protruding obstacles.

A further general problem of effectively and efficiently cleaning the bottom surface exists where the dirt and debris is heavy and/or when the pool has not been regularly cleaned and the movement of water into the intake ports in the bottom or baseplate of the pool cleaner is not sufficient to create the required turbulence at the surface to disturb and lift the dirt and debris into suspension so that it can be drawn to the intake port.

SUMMARY OF THE INVENTION

This invention relates to an improvement in the cleaning methods and apparatus that overcome the above-described shortcomings of pool cleaners of the prior art, whether hand-powered or of the self-propelled and robotic type. The introduction of water jets under the cleaner body, directed inboard and generally toward its center from its sides, agitates and lifts the dirt and debris, which is then moved toward the one or more baseplate intake ports, to greatly enhance the cleaning ability of the apparatus. The suspended dirt and debris become semi-buoyant under the force and turbulence of the jetted water.

In a preferred embodiment, a plurality of the directional water jets moves the debris in the same direction as the cleaner is moving. Thus, the relative speed between the cleaner and the suspended dirt and debris is reduced, enabling the cleaner to move at a relatively faster rate and still clean with equivalent, or even greater efficiency than a pool cleaner that is not equipped with the directional cleaning water jet apparatus. In addition, the front and back orientations of the intake slot allow a longer time for any dirt and debris to be picked up.

DETAILED DESCRIPTION OF THE PREFERRED EMBODIMENTS

Figure 1:
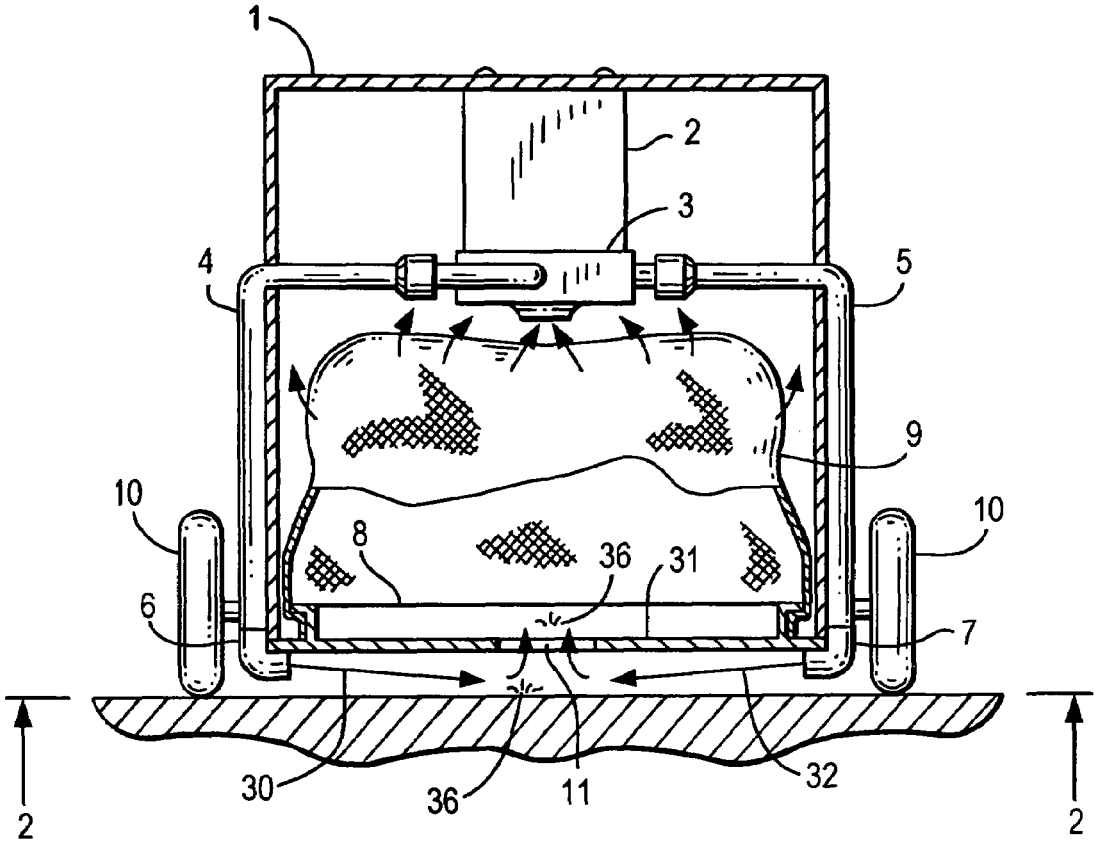
FIG. 1 is a cross-sectional view of a mechanically driven swimming pool cleaner of the present invention.

Referring to FIG. 1, a first embodiment of a self-propelled robotic swimming pool cleaner implementing the present invention is shown, which includes a housing 1, an electric motor 2, a centrifugal pump 3, connecting tubes 4 and 5, jet nozzle elbows 6 and 7, filter bag holder 8, filter bag 9 and wheels 10 supporting the housing 1. The self-propelled swimming pool cleaner can include features known to the prior cleaning apparatus which are moved by the directional control of one or more water jets and valves, such as the apparatus described in U.S. Pat. No. 6,412,133 B1, the disclosure of which is incorporated herein by reference in its entirety.

Figure 2:
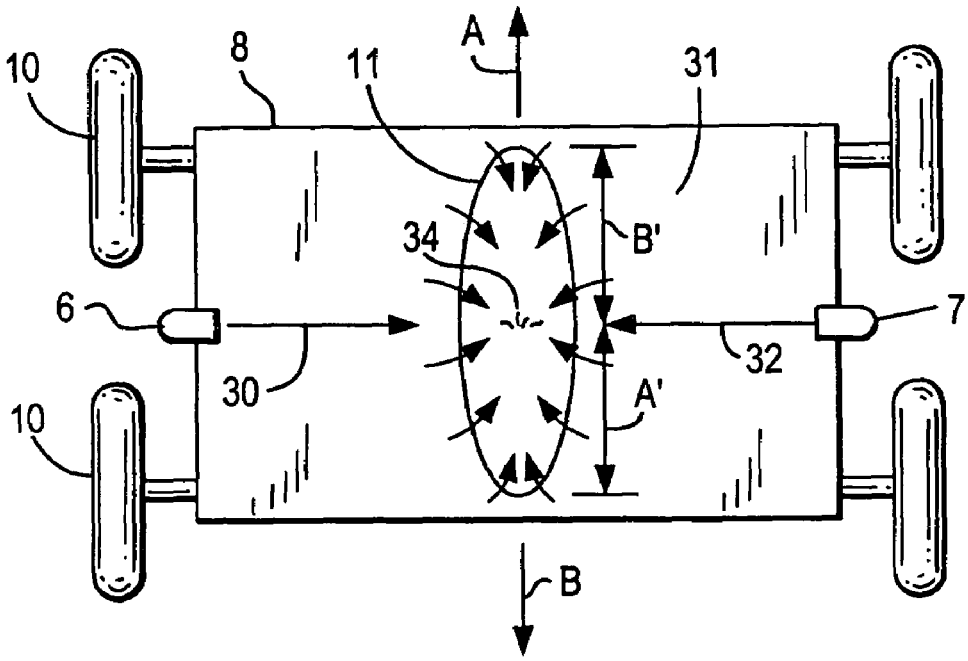
FIG. 2 is a bottom view of the pool cleaner, taken on lines 2—2 of FIG. 1.

As further illustrated in FIG. 2, the water jets 30, 32, are supplied by the centrifugal pump 3 and discharged by the jet nozzles 6, 7, respectively, are directed toward the dirt and debris 36 on the pool surface below the baseplate 31. The baseplate 31 is provided with an oval-shaped aperture forming an intake port 11. The intake 11 is oriented in a front and a back direction, relative to the longitudinal orientation of the jet streams 30, 32, as illustrated in FIG. 2. The streams 30, 32, are aimed at the surface below the middle of the intake 11 so that the combined water flow from the streams 30, 32, accommodates the intake 11 equally regardless of whether the cleaner moves forward or backward. In either case, the trailing half of the intake 11 is always the working half as the turbulence does not benefit the leading half. When the cleaner moves in the direction shown by arrow A, section A' of the intake 11 does most of the cleaning. Conversely, when the cleaner moves in the direction of arrow B, section B' of the intake 11 benefits from the turbulence to draw the suspended debris and dirt into the filter bag.

Figure 6:
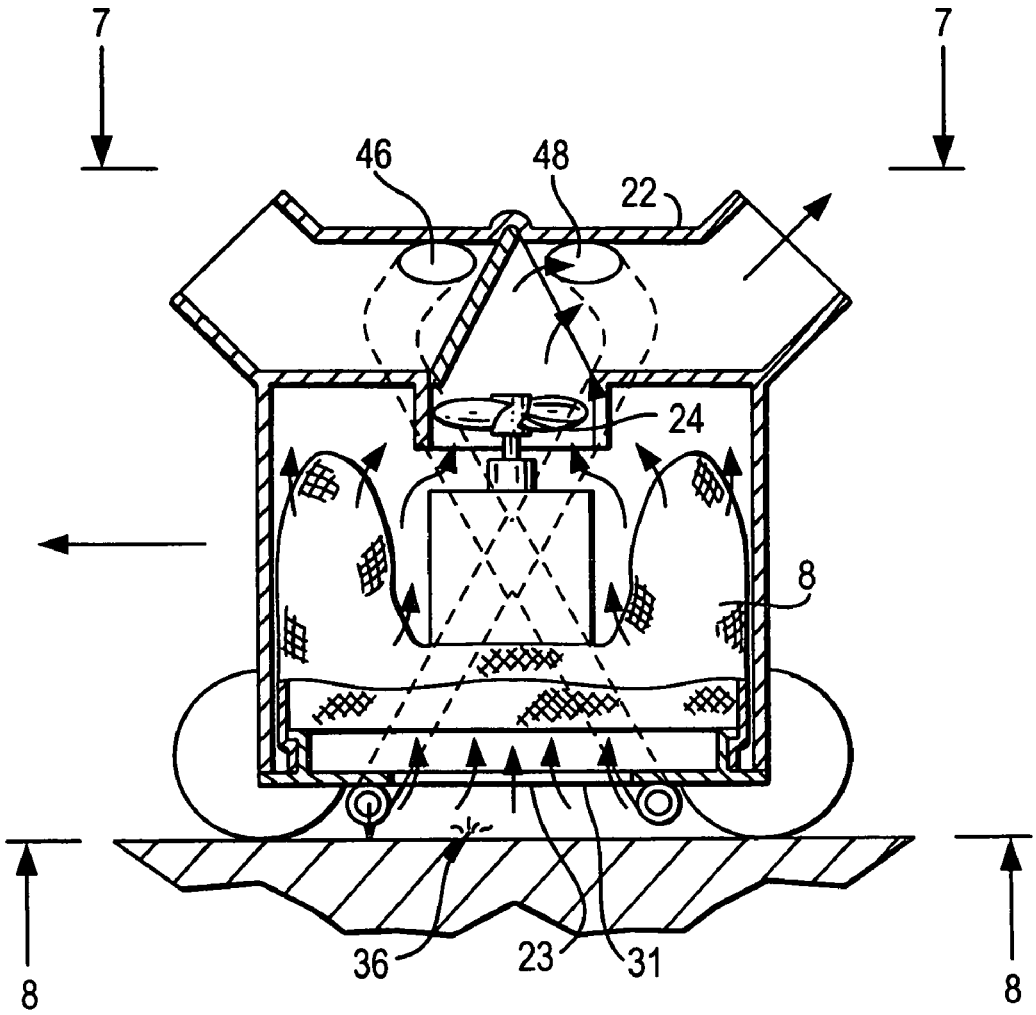
FIG. 6 is a side elevation view, partly in cross-section, of another embodiment of the invention utilized with a cleaner that is moved about the pool by water jet propulsion.

The pool cleaner of this embodiment can also be self-propelled, for example, using discharged water jets from a jet valve housing, such as the housing 22 shown in FIG. 6 as well as discharged water jets described in the incorporated U.S. Pat. No. 6,412,133 B1, employing the pressure from the discharged water jets to move the pool cleaner in selected directions controlled by water valves or other mechanisms. Alternatively, the wheels 10 can be connected to one or more drive motors for selectively moving the pool cleaner along the surface of the pool being cleaned. The drive motors can be electric or water turbine driven by pressurized water.

Although the embodiment shown in FIGS. 1–2 provides far better results than those of prior art pool cleaners, the performance and efficiency can be further improved, as will be described below.

Figure 3:
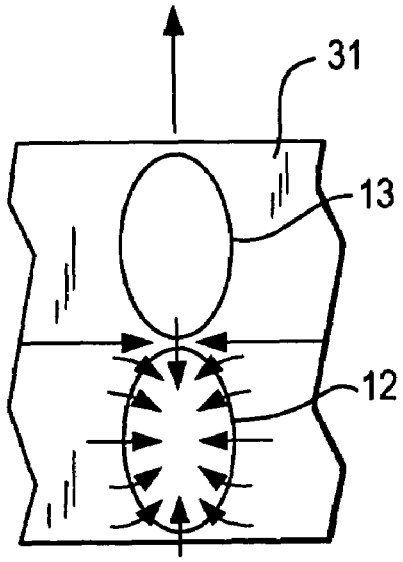
FIG. 3 is an alternative embodiment similar to that of FIG. 2.

In the second embodiment shown in FIG. 3, the one long intake opening of the intake 11 of FIG. 2 is replaced by two smaller openings 12 and 13, one of which is always closed, as by a solenoid switch or other means. Thus, the speed of the intake stream as indicated by the arrows can be doubled.

Figure 4:
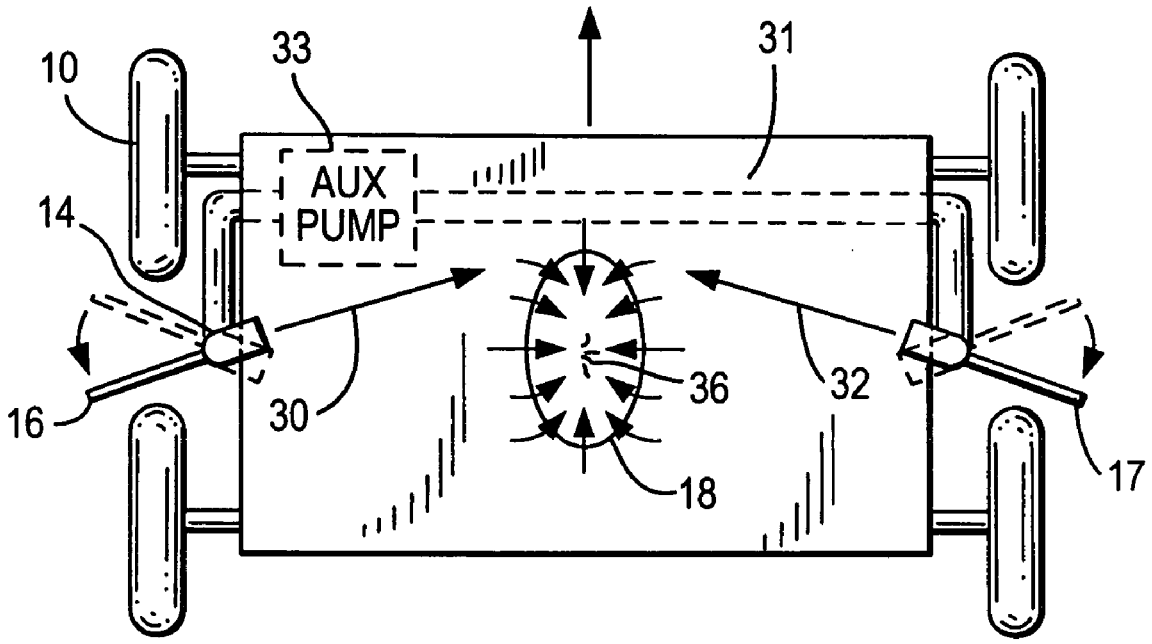
FIG. 4 is a bottom view of yet another embodiment of a pool cleaner similar to that of FIG. 1.

With reference to FIG. 4, there is shown yet another embodiment in which swiveling elbow jet nozzles 14 and 15 are equipped with fins 16 and 17, respectively, which automatically change the positions of the nozzles due to the force of the water, or water resistance, as the cleaner changes direction, to thereby always point to the upstream end of the intake 18. In the angular arrangement of the jet nozzles 14, 15 illustrated in FIG. 4, water is discharged at a predetermined pressure to move the debris 36 at a velocity that greatly reduces the relative speed between the debris 36 and the cleaner optimally to zero. This permits the cleaner to move at a relatively higher speed while the debris 36 is moved along in the same direction as the cleaner until the debris 36 can be drawn into the one or more intake port(s) 18 in the baseplate 31. An optional auxiliary pump 33 can also be used to boost the pressure provided by the streams 30, 32.

Figure 5:
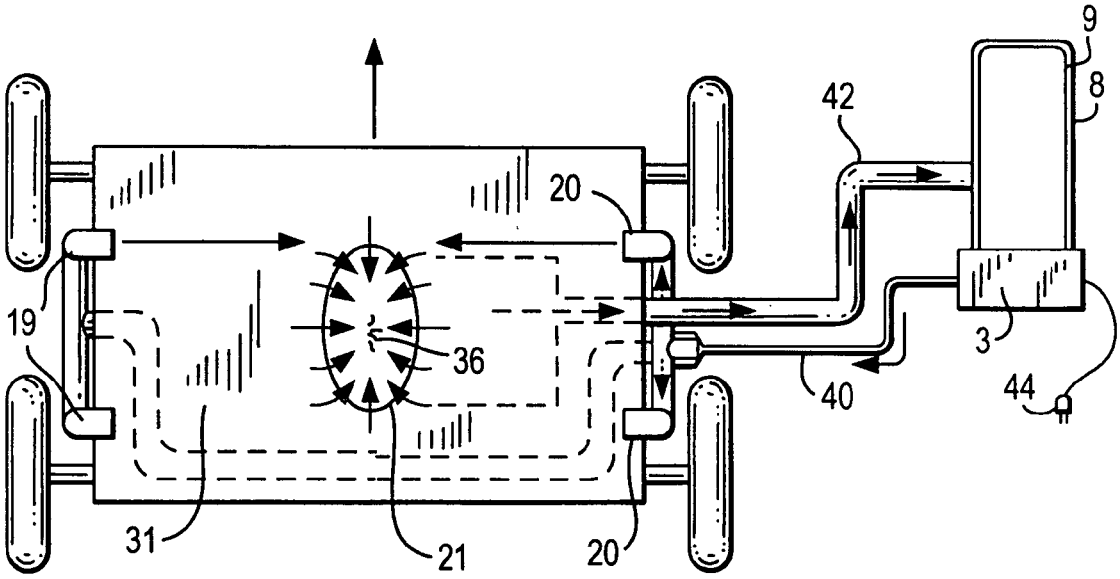
FIG. 5 illustrates a bottom view of yet another embodiment of the invention.

As shown in FIG. 5, another embodiment of the pool cleaner is provided with two pairs of directional nozzles 19 and 20 aimed at the front and rear portions of the intake port 21. A pair of solenoid activated valves (not shown) control the "on" or "off" flow condition of the nozzles 19, 20. In this embodiment, the centrifugal pump 3, the filter bag holder 8, and the filter bag 9 can be positioned external to the pool cleaner. The directional nozzles 19, 20 receive the water jet streams from an output tube 40 of the externally located centrifugal pump 3, and the filter bag 8 receives the intake water and debris 36 via the filter input tube 42. The centrifugal pump 3 is connected to an external power supply (not shown) by an electrical connector such as an electrical plug 44.

Figure 7:
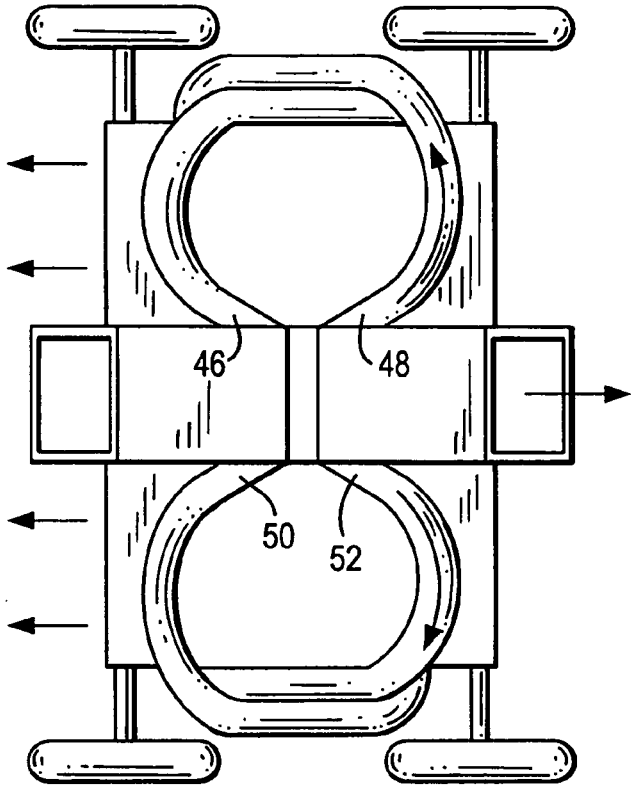
FIG. 7 is the top plan view of the cleaner taken along lines 7—7 of FIG. 6.
Figure 8:
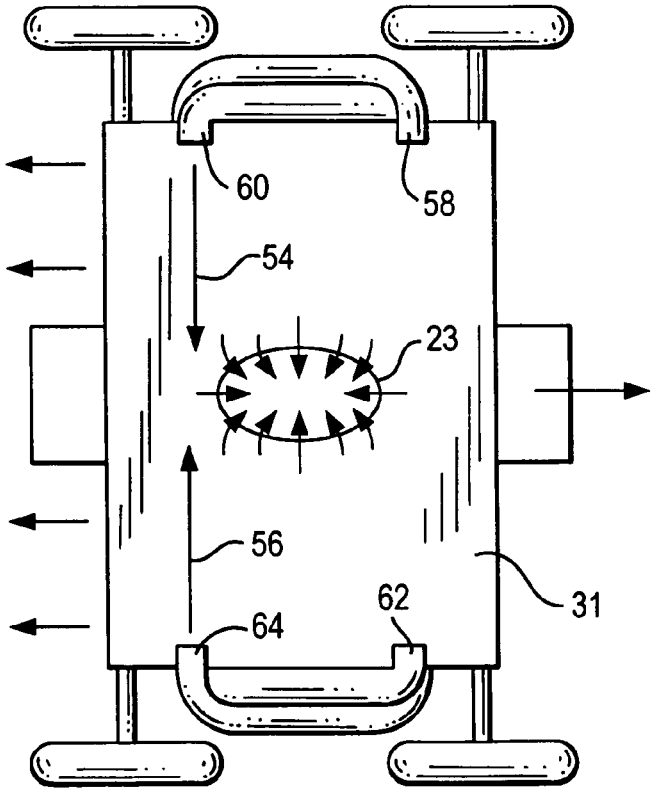
FIG. 8 is a bottom view of the cleaner taken along lines 8—8 of FIG. 6.

FIG. 6 is a side elevation view, partly in cross-section, of another embodiment of the invention fitted to a cleaner that is moved about the pool by water jet propulsion. In this embodiment, the jet valve housing 22 is tapped at four places 46, 48, 50, 52, shown in FIG. 7, to supply the plurality of water jet streams 54, 56 emitted from jet nozzles 58, 60, 62, 64, respectively, as best shown in FIG. 8. Those plurality of water jets function as described above to aid in the movement of dirt and debris 36 toward the intake port or ports in the baseplate 23. This embodiment operates in the same manner as the cleaner of FIG. 4, except that the change from one set of nozzles to the other set, such as the first pair 58, 62 of nozzles to the second pair 60, 64, is accomplished automatically in the jet valve housing 22 when the cleaner changes direction. This construction and method of operation eliminates the need for electronics to operate a solenoid controlled valve and provides a simple mechanism to perform the dual functions of directional control change and the flow to selected positions among the plurality of directionally oriented cleaning water jet nozzles 58, 60, 62, 64.

Figure 9:
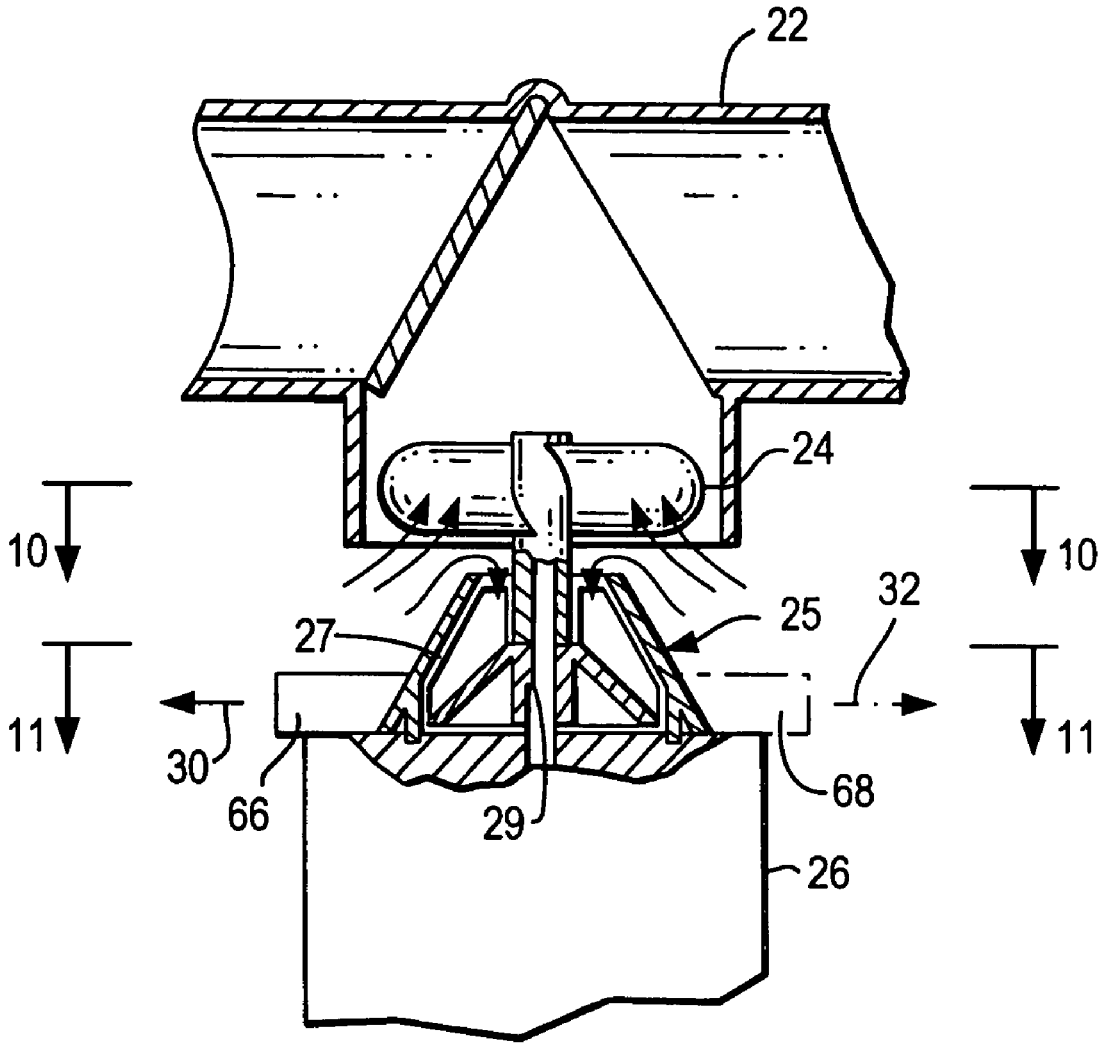
FIG. 9 is a side elevation, partly in cross-section, of yet another embodiment of the invention.

Referring to FIG. 9, a propeller pump 24 and a centrifugal pump 25, functioning as an impeller, are operated by the same motor 26 for use in each of the embodiments shown in FIGS. 1–5. The centrifugal pump 25 is designed to have the shape of a cone to provide the least amount of resistance to the water being pumped by the propeller pump 24. The cone-shaped propeller base 27 also provides easier transition of water going through the impeller housing 28. The cross-section of the impeller blades of the propeller pump 24 corresponds to the cross-section of an airplane wing. This configuration helps to further limit the drag which the impeller puts on the motor shaft 29.

Figure 10:
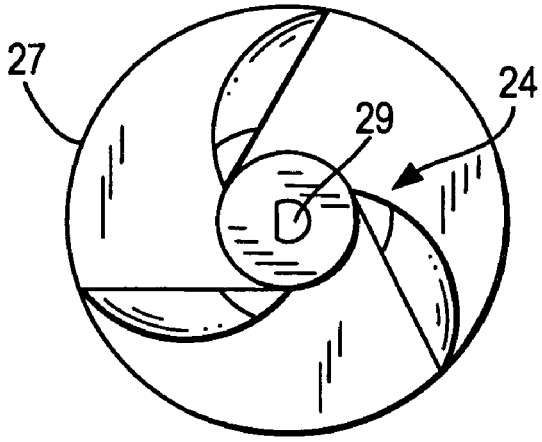
FIG. 10 is a top plan view of the impeller taken along lines 10—10 of FIG. 9.
Figure 11:
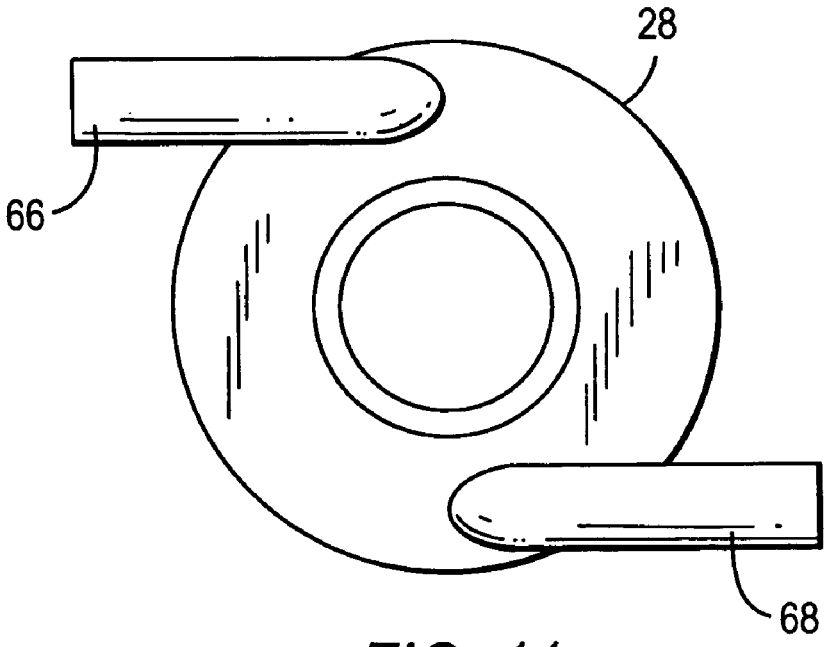
FIG. 11 is a top plan view of the impeller housing taken along lines 11—11 of FIG. 9.

With reference to FIG. 10 and FIG. 11 there is shown the water jet streams 30, 32 emitted from output channels 66, 68, respectively, which are connected to the connecting tubes in the various embodiments, such as the connecting tubes 4, 5 in FIG. 1. Having a centrifugal/impeller pump 25 coupled with a propeller pump 24 is also beneficial for other applications used to control the directional movement of a cleaner. For example, a hydraulic piston, which is normally operated pump powered by a small DC motor to arrest one side of moving cleaner, can be operated without the cost of the DC motor.

Figure 12:
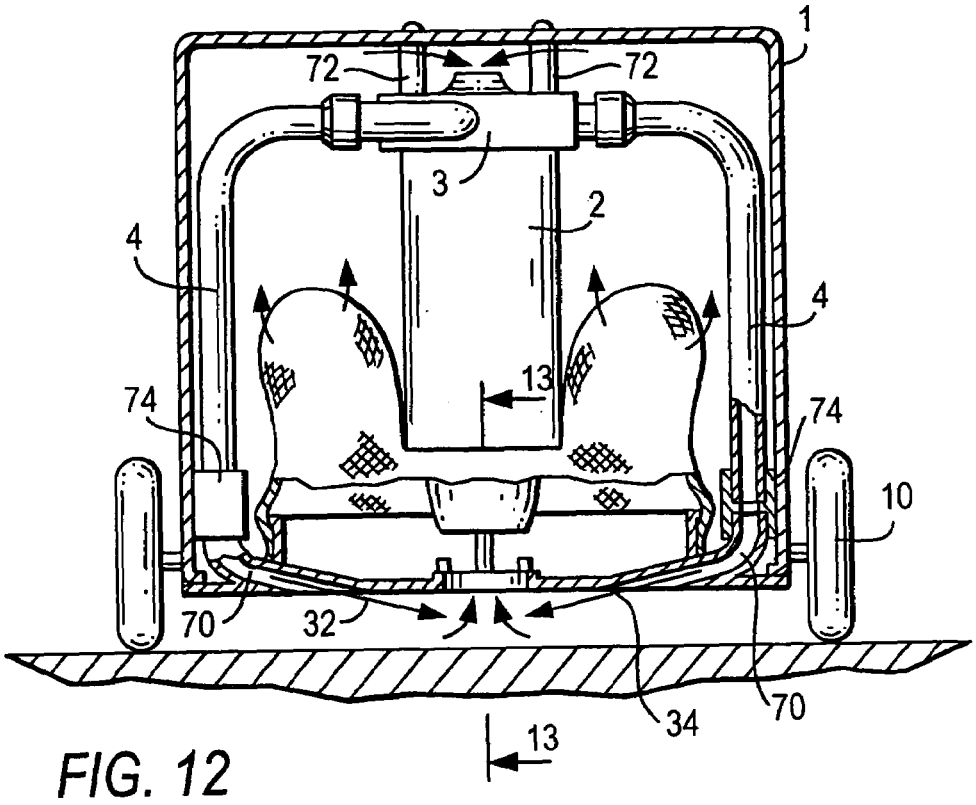
FIG. 12 is a cross-sectional view of a manually propelled pool cleaner in which the water jet delivery tubes are shown partly in section.

In FIG. 12, there is illustrated in a cross-sectional view, a manually propelled cleaner that is equipped with a bottom or baseplate 76 intake assembly which has a pair of water jet nozzles 70 permanently mounted at its opposite ends. The cleaner is also fitted with a centrifugal pump 3 that is secured to housing 1. In this embodiment water delivery tubes 4 are positioned inside the housing 1. Inner ends of said jets are slidably connected to delivery tubes 4 by couplings 74 that are also mounted inside the main housing.

Baseplate 76 intake assembly has an elongated slot 11 perpendicular to the direction of the adjacent water jets. Inside, covering said slot 11 are a pair of flaps 78 that open when suction pump 2 is on and close when power is turned off.

Figure 13:
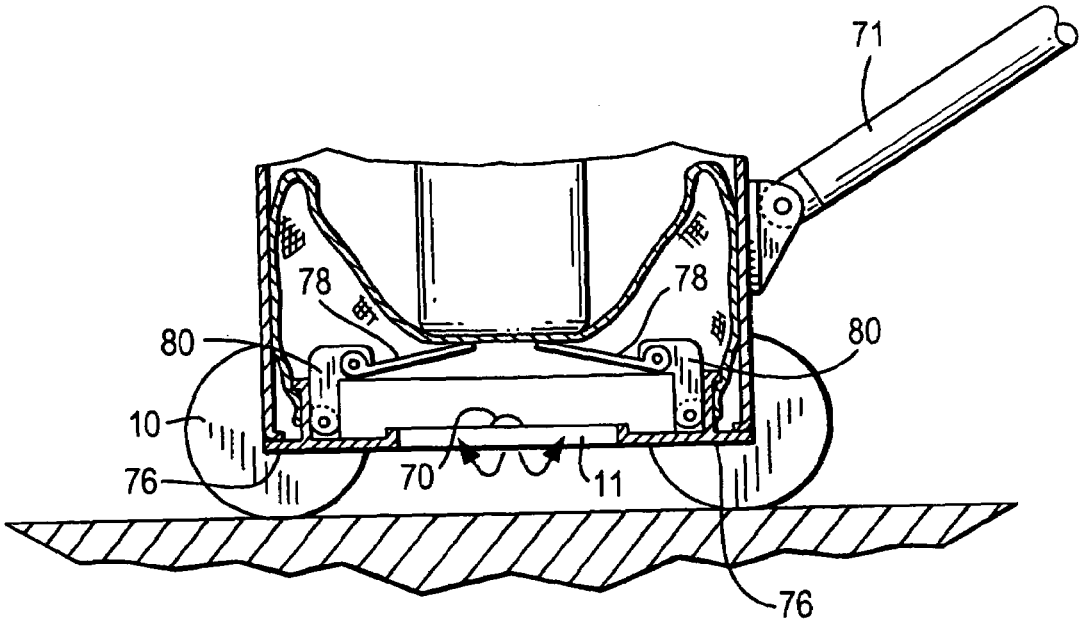
FIG. 13 is a segment of a cross-sectional view taken along line 13—13 of FIG. 12 showing intake flaps in the open position.
Figure 14:
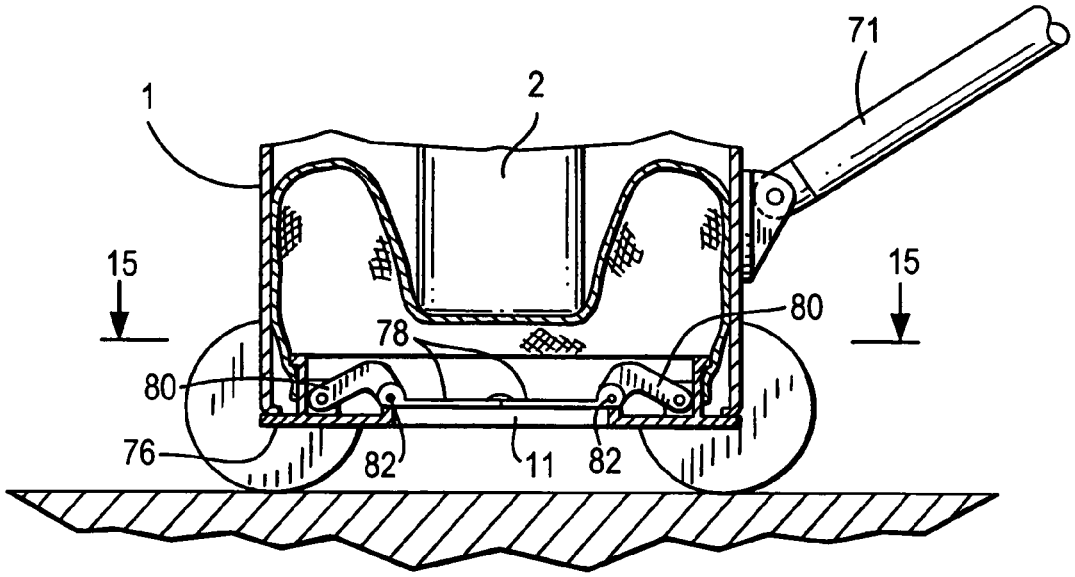
FIG. 14 is a view similar to FIG. 13 in which the intake flaps are in the closed position.

FIG. 13 illustrates a double pivot hinge mechanism having an "L" shaped hinge transfer member 80 connected to each flap 78. This allows the flaps to lift off said slot 11 higher at their hinged ends than would otherwise be possible. This relationship and the functioning of the hinge members 80 are further illustrated in FIG. 14 where the flaps are shown in closed position. In the embodiment of FIGS. 12–15, the cleaner is manually propelled by handle 71.

Figure 15:
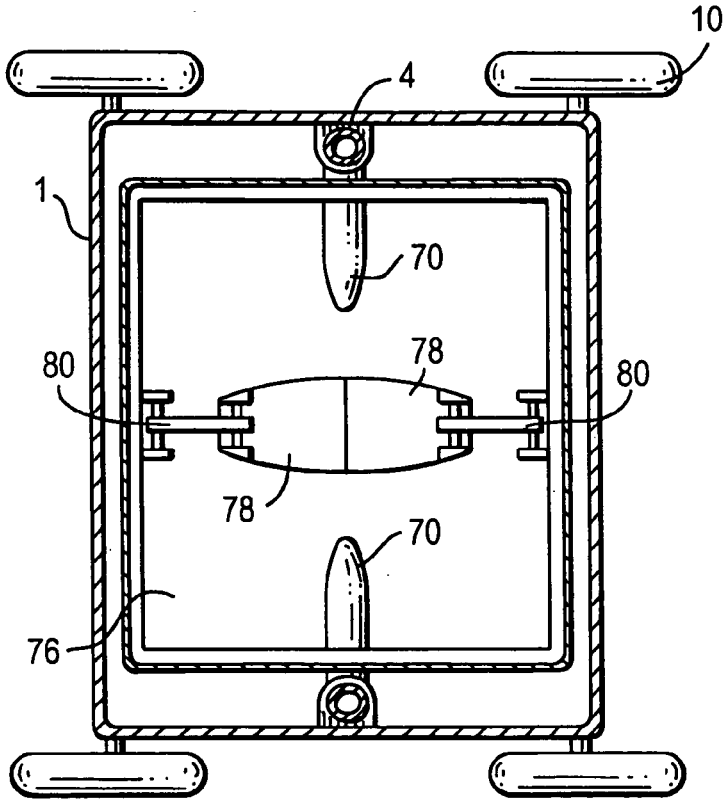
FIG. 15 is a cross-sectional view taken along line 15—15 of FIG. 14.

In the interior cross-sectional view of FIG. 15, the flaps 78 are shown in the closed position, each flap supported by a single hinge member 80. As will be understood by one of ordinary skill in the art, two or more hinge members 80 can be employed should the size of the intake 11 and/or flaps 78 be increased. The pivot means 82 permit the flaps to move easily in response to the water pressure during flow to settle in the closed position.

Figure 16:
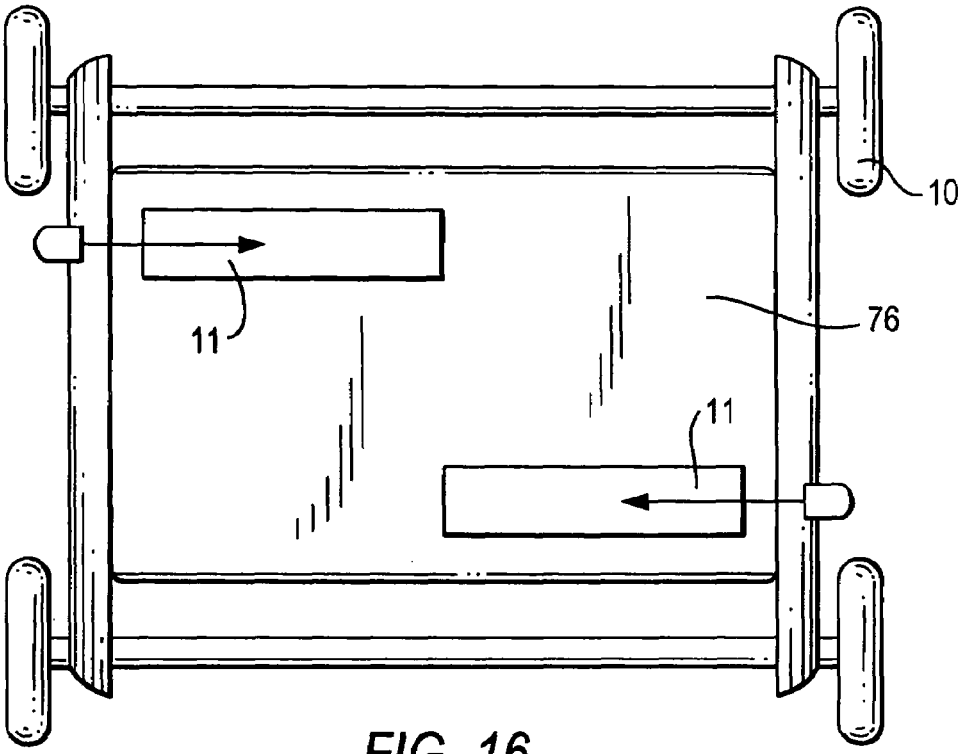
FIG. 16 is a bottom view of another embodiment of a pool cleaner fitted with the water jet cleaning system of the invention.

FIG. 16 is a bottom view of another water jet assisted cleaner that is equipped with a conventional baseplate intake assembly in which the major axis of the intake slot is parallel to the direction of their respective associated water jets. Although the direction of said slots are not in an optimum angle (front and back), the cleaning efficiency is still greatly increased when water jets are introduced to assist in raising the dirt and debris into suspension below the moving cleaner.

Figure 17:
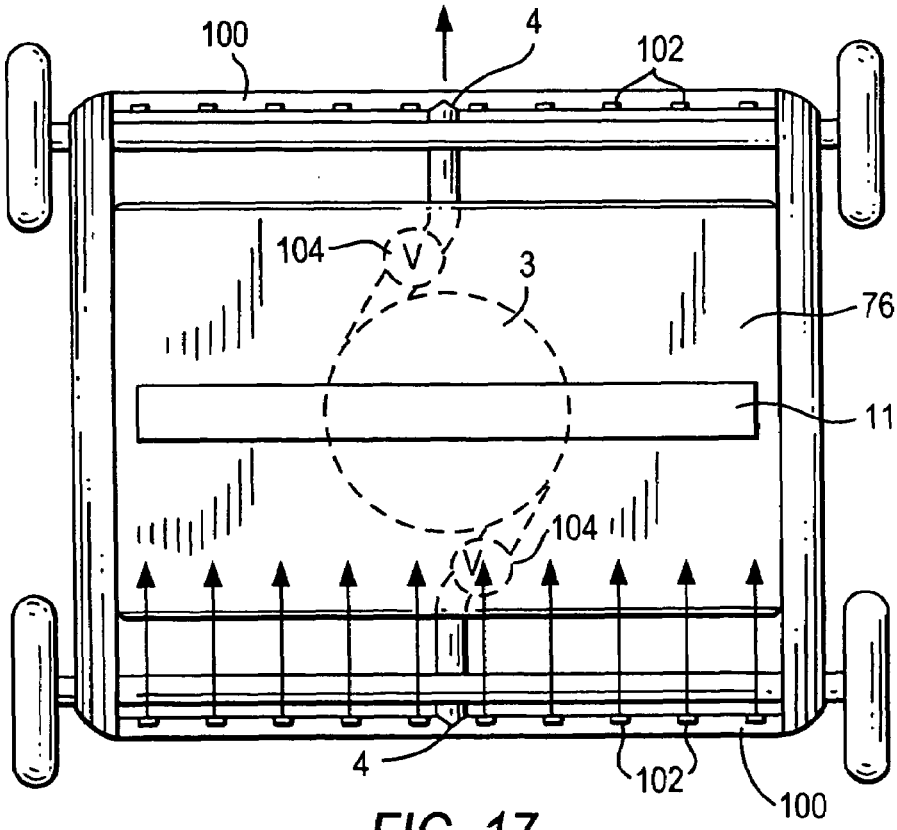
FIG. 17 is a bottom view of a pool cleaner equipped with a further embodiment of the invention.

FIG. 17 is a bottom view of yet another cleaner in which the intake slot is perpendicular to the movement of the cleaner and a pair of manifolds 100 are located parallel to said intake slot 11 in the front and back ends of the cleaner to provide multiple jet streams through a number of small water jet discharge openings 102 along the length of said manifold, aiming slightly down, but mainly toward said intake slot 11. In this embodiment, the single intake slot 11 extends substantially across the baseplate. A pair of valves 104 control the water flow from centrifugal pump 3 so that only the trailing manifold is activated, sweeping the debris forward, along with the moving cleaner, until it is picked up with water drawn into the intake slot 11. In a preferred embodiment, each of the discharge openings 102 is provided with a low friction fitting to minimize the back pressure in the system and enhance the turbulent effect of the water stream to suspend dirt and debris.

An additional benefit of this arrangement is that the cleaner can clean very close to a sharp-cornered vertical pool wall. Although the plurality of water jet streams trail the moving cleaner, when said cleaner stops at the wall and reverses its direction, the trailing manifold begins sweeping the swimming pool floor close to the vertical wall.

In another embodiment of the manifolds of FIG. 17 (not shown), of the control valves, are omitted, leaving open the flow path to both delivery tubes and manifolds. Although the front water jets will be sweeping the debris backwards against the directional movement of cleaner, the rear water jets sweeping forward trap debris under intake port 11 until it is picked up.

Figure 18:
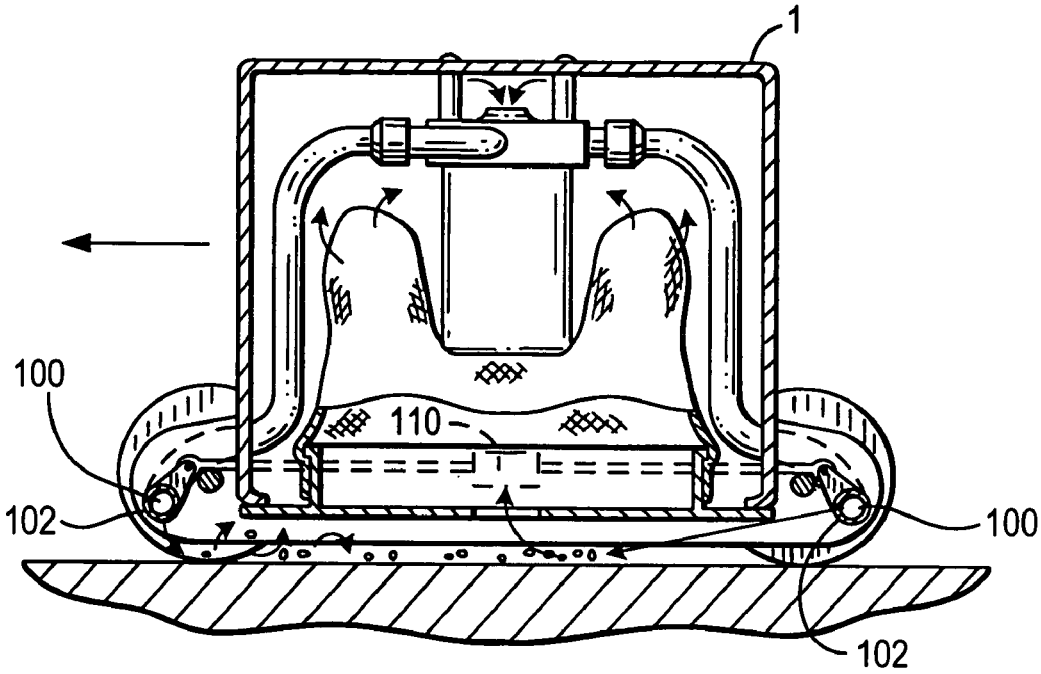
FIG. 18 is a cross-sectional side elevation view of a further embodiment of the invention.

Referring to the embodiment of FIG. 18, valves controlling the water jet manifolds are replaced by solenoids 110 which automatically turn a pair of swiveling manifolds 100 so that the leading manifold's water jets 102 are aimed substantially downward, stirring up the debris, while the trailing manifold's water jets are aimed substantially forward, sweeping the debris along with the moving cleaner. Both manifolds are open at all times.

Figure 19:
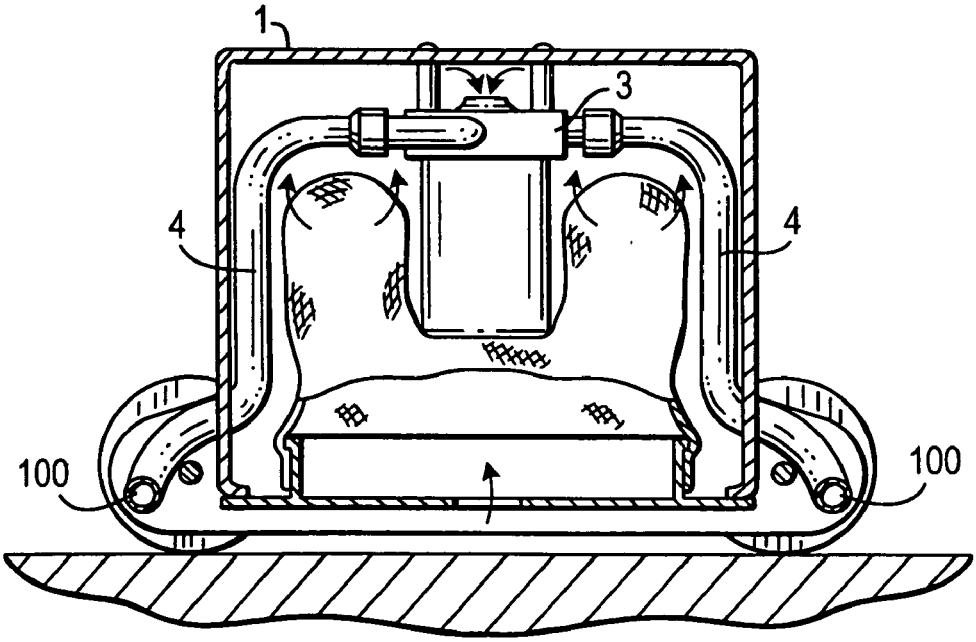
FIG. 19 is a cross-sectional side elevation view of another simplified embodiment of the invention.

With reference to FIG. 19, there is illustrated an embodiment in which both manifolds 100 are in a fixed position with their water jets aimed substantially downward. Although this fixed positioning of the water jets may not be as efficient in cleaning as those described above, it will outperform prior art cleaners that are not assisted by water jets. The elimination of electronics components that are necessary to operate solenoids and/or other automatic switching mechanisms makes this embodiment of the invention particularly cost-effective to produce.

There are other benefits and advantages from the embodiments illustrated and described above that will be apparent to those skilled in the art.

We claim:

1. A pool cleaning apparatus comprising:

a housing;

a baseplate extending along a bottom portion of the housing and adapted for interfacing with an underwater surface;

at least one intake port formed in the baseplate;

pump means for drawing water from beneath the baseplate and through the at least one intake port;

a plurality of directional cleaning water jet outlets located beneath the baseplate, said plurality of directional cleaning water jet outlets being orientated in a direction toward said surface and the at least one intake port for discharging a pressurized water jet stream beneath the baseplate, said pump means further providing said pressurized water jet streams to said directional cleaning water jet outlets;

a filter coupled between said at least one intake port and pump means for filtering said dirt and debris from said drawn water; and switching means coupled to said cleaning water jet outlets for selectively activating and deactivating each water jet outlet in response to a change in direction of movement of said cleaning apparatus, such that the directional orientation of the active water jet outlets discharging water at the surface is at least partially upstream of the at least one intake port admitting water, wherein said at least one intake port draws in dirt and debris lifted from the surface that is contacted by the discharging water jet streams.

2. The apparatus of claim 1 wherein the apparatus is self-propelled.

3. The apparatus of claim 1, wherein the filter is located inside of the housing.

4. The apparatus of claim 1, wherein the pump is located inside of the housing.

5. The apparatus of claim 1 having one intake port with a longitudinal axis extending in the direction of movement and centered in the baseplate of the pool cleaner.

6. The apparatus of claim 1, wherein the at least one intake port includes:

a pair of intake ports, each port having a longitudinal axis extending in the direction of movement of the pool cleaner, and means for selectively closing one of the pair of intake ports when the other intake port is open.

7. The apparatus of claim 1, further comprising:

means for selectively delivering a pressurized stream of water to a first and then a second directionally oriented one or more of the plurality of cleaning water jet outlets.

8. The apparatus of claim 1, further comprising:

at least one conduit in fluid communication with an outlet of the pump means and the at least one directional cleaning water jet outlet.

9. The apparatus of claim 1, wherein the pump means is contained in the housing and includes:

a first pump; and a second pump, wherein the fluid discharge of the first pump is delivered to the at least one directional cleaning jet and the discharge of the second pump is delivered to a discharge port extending through an upper wall of the housing.

10. The apparatus of claim 9, further comprising:

a pump motor positioned inside the housing; and a drive shaft extending from the pump motor, the first and second pumps being operationally mounted on the drive shaft.

11. The apparatus of claim 10, wherein the first pump is a centrifugal pump and the second pump is a propeller pump.

12. The apparatus of claim 11, wherein the centrifugal pump is positioned proximate the pump motor and the propeller pump is positioned proximate the discharge port in the housing.

13. The apparatus of claim 9 further comprising:

a bi-direction water jet propulsion assembly mounted on the exterior of the cleaner housing for receiving a pressurized stream of water from the discharge port, the assembly including:

directional control means; and at least one directional discharge conduit, whereby the pressurized stream is discharged to alternatively propel the pool cleaner over the surface to be cleaned in a first direction and in a second opposite direction.

14. The apparatus of claim 1, wherein the at least one water jet outlet comprises first and second conduits extending in the direction of movement of the apparatus and spaced apart from the at least one intake port, each of said conduits including a plurality of outlets directed at the surface of the pool beneath the apparatus, wherein the first and second conduits alternatively discharge a plurality of water jet streams.

15. A pool cleaning apparatus comprising:

a housing and an associated baseplate having an intake port formed therein and extending either parallel or transverse to the direction of movement of the pool cleaner;

at least two water jet outlets for discharging pressurized streams of water at a pool surface beneath the base plate of the housing toward the intake port, where the directed water contains dirt and debris removed from the surface by the pressurized streams, a first portion and second portion of said at least two water jet outlets respectively being disposed proximately at opposing ends beneath the baseplate, wherein one of said portions of jet outlets discharges water in response to a change in direction of movement of the apparatus, such that directional orientation of a water jet outlet discharging water at the surface is at least partially upstream of the intake port admitting water;

a filter for entraining the dirt and debris removed from water passing through the intake port; and a pump for drawing the directed water through the intake port and the filter.

16. A pool cleaning apparatus comprising:

a housing;

an associated filter for entraining dirt and debris;

a baseplate extending along a bottom of the housing;

at least one intake port in the baseplate for admitting water into the filter, the at least one intake port defining a zone of low pressure relative to an adjacent region beneath the baseplate;

pump means for drawing water from beneath the pool cleaner baseplate and through the at least one intake port and through the filter;

at least one directional cleaning water jet outlet located beneath the baseplate for discharging a pressurized water jet stream at the pool surface beneath the pool cleaning apparatus, whereby dirt and debris resting on the surface that is contacted by the pressurized stream is lifted into suspension proximate the intake port; and wherein at least one of the at least one jet outlets discharging water or the at least one intake port admitting water changes in response to a change in direction of movement of the apparatus such that the directional orientation of the at least one water jet outlet discharging water at the surface is at least partially upstream of the at least one intake port admitting water.

* * * * *